US006735821B1

(12) United States Patent
Christman, Jr.

(10) Patent No.: US 6,735,821 B1
(45) Date of Patent: May 18, 2004

(54) JOINT COVER

(76) Inventor: Peter E. Christman, Jr., 3 Colonel Wilkins Rd., Amherst, NH (US) 03031

( * ) Notice: Subject to any disclaimer, the term of this patent is extended or adjusted under 35 U.S.C. 154(b) by 0 days.

(21) Appl. No.: 10/304,893

(22) Filed: Nov. 26, 2002

(51) Int. Cl.[7] ..... E05D 11/00
(52) U.S. Cl. ..... 16/250; 16/274
(58) Field of Search ..... 16/250, 251, 273, 16/274; 118/301, 504, 505

(56) References Cited

U.S. PATENT DOCUMENTS

| | | | | | |
|---|---|---|---|---|---|
| 3,181,197 | A | * | 5/1965 | Sperber | 16/274 |
| 4,234,760 | A | * | 11/1980 | Lawson | 174/138 F |
| 4,570,291 | A | * | 2/1986 | Smith et al. | 16/250 |
| 4,575,898 | A | * | 3/1986 | Carlson et al. | 16/274 |
| 4,679,285 | A | * | 7/1987 | Ballantyne | 29/11 |
| 4,691,409 | A | * | 9/1987 | Torgerson et al. | 16/250 |
| 4,796,330 | A | * | 1/1989 | Ziegler | 16/251 |
| 5,198,031 | A | * | 3/1993 | Derstine | 118/505 |
| 5,224,240 | A | * | 7/1993 | Smith et al. | 16/251 |
| 5,432,979 | A | * | 7/1995 | Harper | 16/251 |
| 6,165,269 | A | * | 12/2000 | Kathe | 118/505 |

FOREIGN PATENT DOCUMENTS

| | | | |
|---|---|---|---|
| JP | 2000-230696 A | * | 8/2000 |
| JP | 5-340500 | * | 12/2000 |
| JP | 2001-165143 A | * | 6/2001 |

* cited by examiner

*Primary Examiner*—Chuck Y. Mah
(74) *Attorney, Agent, or Firm*—Bourque & Associates, P.A.

(57) ABSTRACT

A lubrication cover, for a joint such as a hinge or other similar device, includes a body defining a cavity and at least one aperture. The body is made from a stretchable material and is sized to allow the cavity to fit snuggly around the hinge. The body preferably includes at least one tab to facilitate the placement of the cover around the hinge. In practice, a user places the cover around the hinge. Next, the user introduces a lubricant into the cavity through the aperture. The cover prevents the lubricant from being applied to an area other than on the joint itself, thereby eliminating the creation of a mess and damaging other objects. If left in place, the cover also ensures that the lubricant will be in close proximity with the hinge, and protects the hinge from foreign material such as dirt, water, and the like.

27 Claims, 2 Drawing Sheets

JOINT COVER

TECHNICAL FIELD

The present invention relates to joints and more particularly, relates to lubrication and protection of joints such as hinges.

BACKGROUND INFORMATION

Noisy and squeaking joints, such as hinges, are a common and annoying problem. While it is possible to apply a lubricant to these noisy hinges, several problems still persist.

The first problem is that the lubricant, whether it is an aerosol or other spray type lubricant, a viscous grease type lubricant, oil, graphite, silicon, or white lithium grease, often creates a mess by dispersing to an area beyond the immediate hinge area. When applying the spray type lubricants, the user often applies too much, causing the lubricant to drip onto the door, doorframe, or flooring where it can permanently damage expensive carpets, woodwork, or tiles. While these spray type lubricants are easy to apply, the user often inadvertently sprays the lubricant on unintended areas such as the doorframe or the door itself, thus creating a mess or worse, damaging an expensive door or doorframe.

The viscous grease type lubricants also suffer from several problems. They are often very difficult and frustrating to apply, frequently forcing the user to apply the grease with his/her hands in order to get the grease into the desired location. Because of the difficulty in applying the grease, excess grease is frequently applied which can easily fall onto the floor or be smeared onto a passerby who accidentally brushes up against the hinge.

Accordingly, what is needed is a device to prevent the mess associated with the lubrication of joints such as hinges. The device should be relatively inexpensive, and should not require extensive modification or replacement of an existing joint. Moreover, the device should reduce the amount of maintenance involved in keeping a joint properly lubricated while protecting the immediate area from excess or overspray lubricant.

SUMMARY

The present invention features a lubrication cover for a joint. The cover prevents the mess associated with the lubrication of joints, such as hinges, and reduces the amount of maintenance involved in keeping a joint properly lubricated. The cover includes a body made from a stretchable material such as, but not limited to, rubber, plastic, neoprene, and synthetic materials. The body forms a cavity sized to fit snuggly over the joint when the cover is in a stretched position. The body also includes at least one aperture adapted to allow a user to have access to the cavity formed by the body.

Optionally, the body further includes at least one tab to facilitate or aid in the placement of the cover over the joint. In a preferred embodiment, the body includes a first and at least a second tab disposed on a first and at least a second end of the body respectively. The tab may be an integral element of the body or a separate element.

The aperture may include a lid, a cover, or a plug. Optionally, the aperture includes a raised protrusion such as, but not limited to, a conical shaped protrusion, to facilitate the introduction of a lubricant into the cavity. According to a one embodiment, the aperture includes an adapter adapted to be connected to a grease gun.

BRIEF DESCRIPTION OF THE DRAWINGS

These and other features and advantages of the present invention will be better understood by reading the following detailed description, taken together with the drawings wherein.

DETAILED DESCRIPTION OF THE PREFERRED EMBODIMENTS

Figure 1:
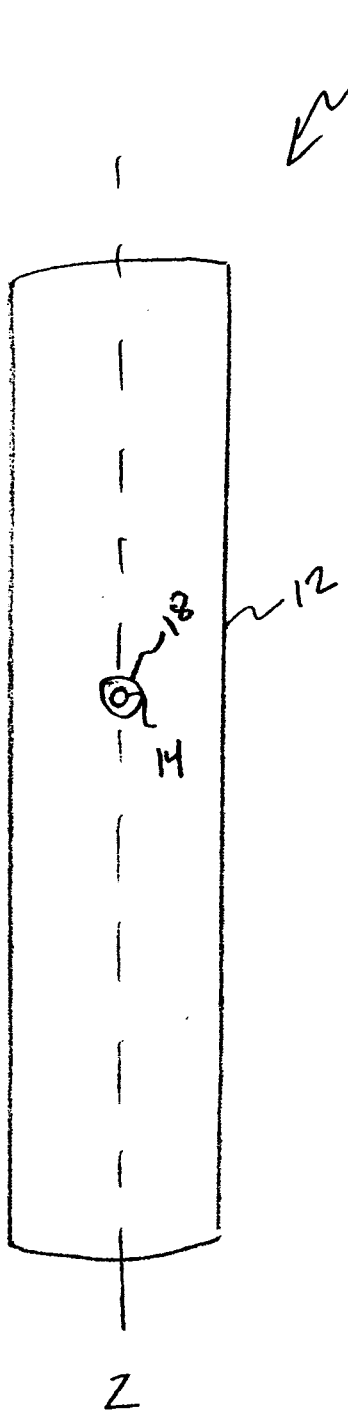
FIG. 1 is a plan front view according to one embodiment of the present invention.
Figure 2:
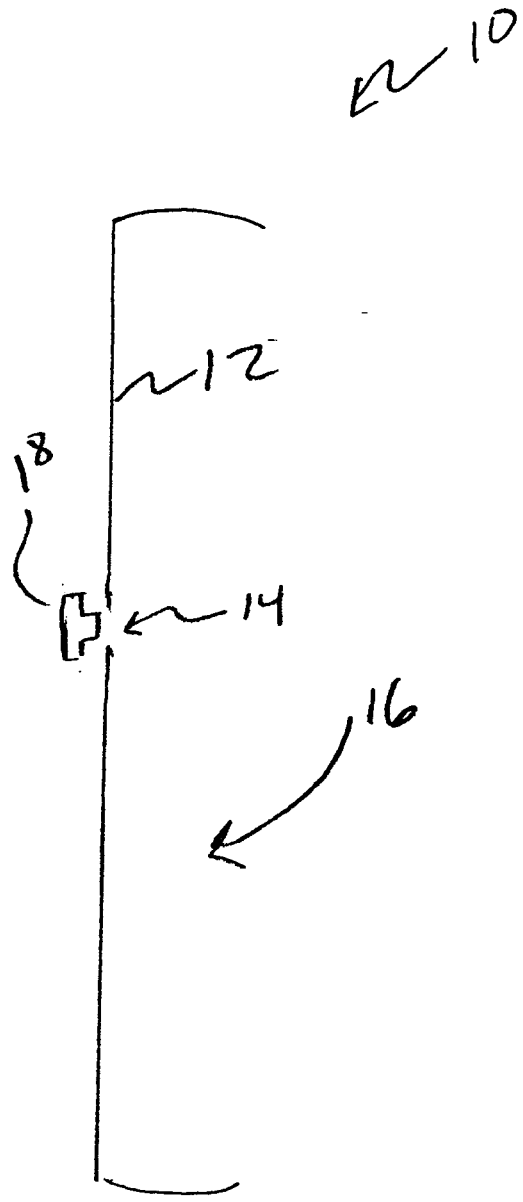
FIG. 2 is a cross-sectional view of FIG. 1.

A joint cover 10, FIGS. 1–2, in accordance with the present invention, allows a user to easily and quickly lubricate a joint (not shown) such as, but not limited to, a hinge or any other device with moving parts. The joint cover 10 preferably includes a body 12 having at least one aperture 14.

In practice, a user places the joint cover 10 around the intended joint. Using the aperture 14, the user then introduces a lubricant into a cavity 16 formed by the body 12. The joint cover 10 retains the lubricant in the cavity 16, thus preventing the lubricant from creating a mess and damaging other objects such as walls, doors, doorframes, floors, clothing, and other objects. Once the lubricant has been applied, the cover may then be removed and used to lubricate another joint.

In another embodiment, the user may maintain the joint cover 10 on the joint thereby maintaining the lubricant in close proximity with the joint, thus ensuring that the joint will be properly lubricated and thereby reducing the amount of maintenance required to keep the joint in proper working condition. In this embodiment, the joint cover 10 also acts as a barrier to prevent foreign material such as dirt, water, and the like from coming in contact with and damaging the joint.

The body 12 is made from a stretchable material such as, but not limited to, plastic, rubber, neoprene, or any stretchable synthetic material. The body 12 forms a cavity 16 that is sized to be slightly smaller than the smallest joint that the joint cover 10 is intended to cover such that the joint cover 10 will fit snuggly around the joint. The exact dimensions of the joint cover 10 will depend on the dimensions of the intended joints to be covered, and are within the knowledge of one skilled in the art. Because the body 12 can stretch, a single joint cover 10 can fit a wide range of joints. As an example only, a joint cover 10 designed to cover a traditional residential door hinge could have a length of approximately 3.5–4.625 inches and a width of approximately 0.25–0.5 inches.

Figure 3:
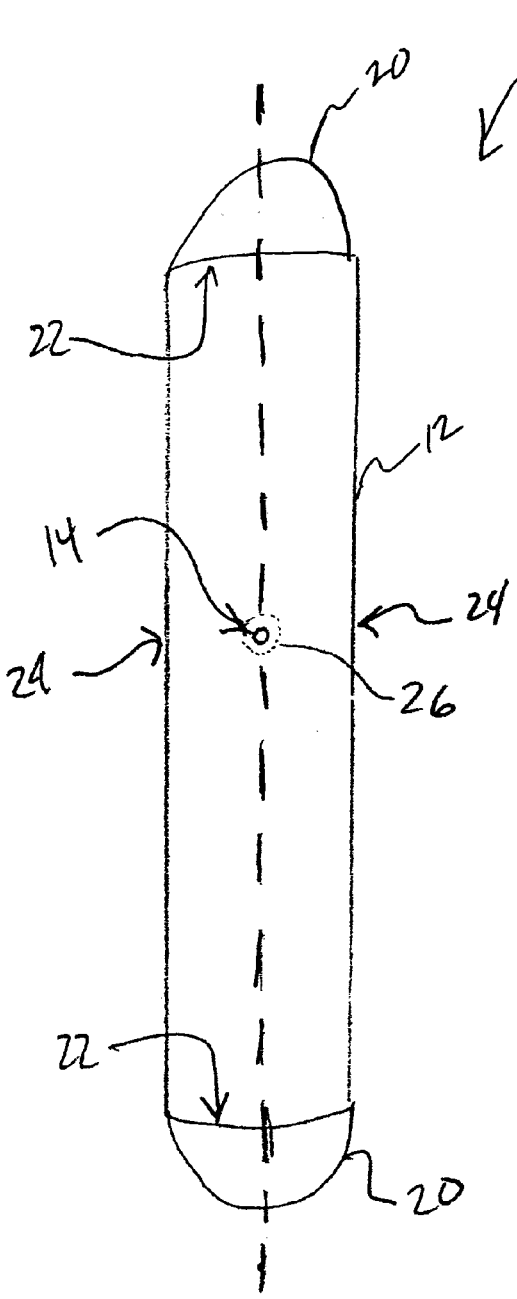
FIG. 3 is a plan front view according to another embodiment of the present invention.

The body 12 may also include one or more tabs or protrusions 20, FIG. 3. The tabs 20 facilitate the stretching of the joint cover 10 around the joint. The tabs 20 may be molded into the body 12, or may be a separate piece. While the tabs 20 are shown at the ends 22 of the body 12, they 20 may also be disposed on the sides 24 as well.

The body 12 also includes at least one aperture 14, FIGS. 1–2. The aperture 14 is used to introduce the lubricant into the cavity 16. In one embodiment, the body 12 may include multiple apertures 14 (not shown) to facilitate even distribution of the lubricant within the cavity 16 when covering large joints or joints with complex elements. The aperture 14 may include a cover 18 such as, but not limited to, an opening, or a removable lid or plug to prevent the lubricant from escaping from the cavity 16. Alternatively, the aperture 14 may be made from a resilient, stretchable material such that the aperture 14 forms a seal.

Figure 4:
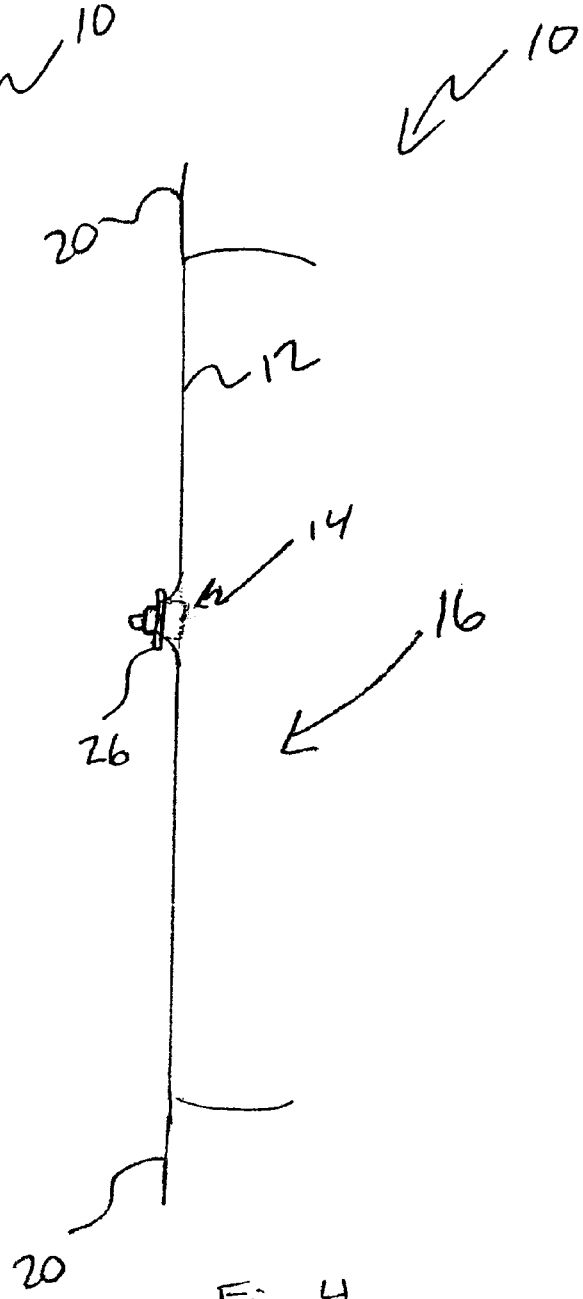
FIG. 4 is a cross-sectional view of FIG. 3.
Figure 2:
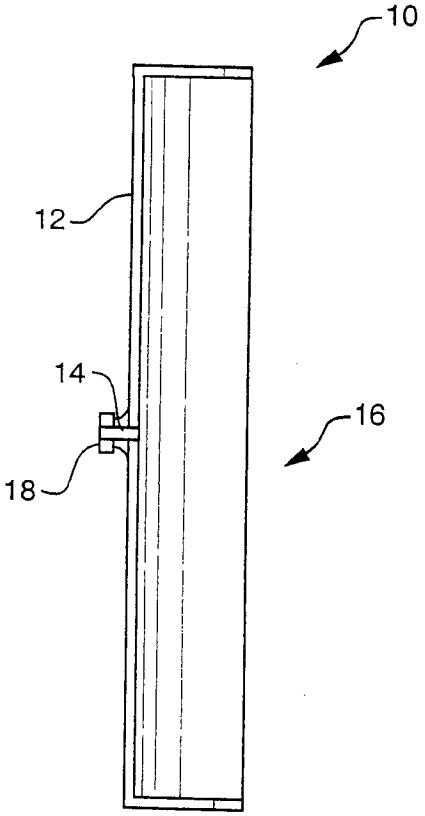
Figure 1:
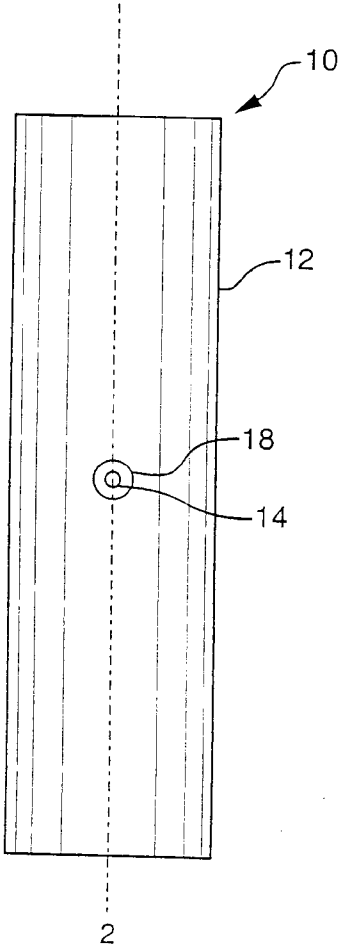
Figure 4:
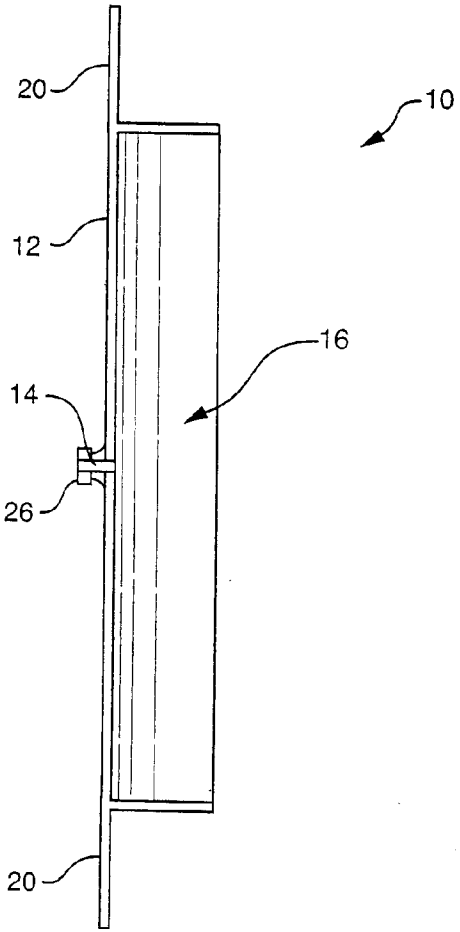
Figure 3:
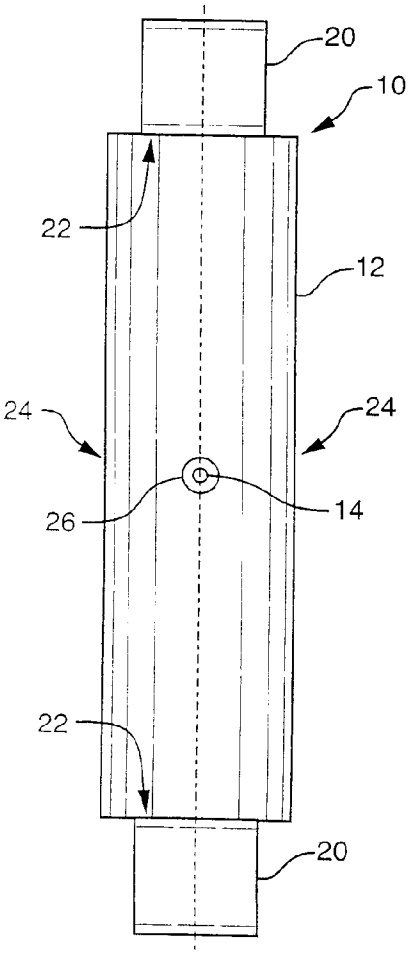

In a preferred embodiment, the aperture 14, FIGS. 3–4, includes a raised opening. The raised preferably includes a conical-shape as shown. Alternatively, the conical-shaped raised opening may be inverted. The aperture 14 may include an adapter 26, such as but not limited to a standard grease fitting, for connecting a grease gun (not shown) to facilitate the introduction of a grease-type lubricant into the cavity 16. Alternatively, the adapter 26 may include an aperture (not shown) designed to facilitate the introduction of a spray tube of the type commonly found on aerosol type lubricants.

Accordingly, the present invention solves all the problems associated with the prior art. The joint cover 10 is easy to use and relatively inexpensive to manufacture. Moreover, the present invention can be used with existing joints without modification to the joint itself.

Modifications and substitutions by one of ordinary skill in the art are considered to be within the scope of the present invention, which is not to be limited except by the following claims.

What is claimed is:

1. A cover for a joint comprising:

a single, unitary body made from a stretchable material, said body forming a cavity sized to fit snuggly over generally said entire joint when said cover is in a position installed over said joint;

at least one removal tab, said at least one removal tab for facilitating removal of said body once installed over said joint; and at least one aperture in said body, said aperture adapted to allow a user to have access to said cavity formed by said body.

2. The cover as claimed in claim 1 wherein said body includes a first and at least a second said tab disposed on a first and at least a second end of said body respectively.

3. The cover as claimed in claim 2 wherein said first and at least said second tab are an integral element of said body.

4. The cover as claimed in claim 1 wherein said body is made from a material selected from the group consisting of rubber, plastic, neoprene, and synthetic materials.

5. The cover as claimed in claim 1 wherein said body is made from rubber.

6. The cover as claimed in claim 1 wherein said body is made from plastic.

7. The cover as claimed in claim 1 wherein said body is made from a synthetic material.

8. The cover as claimed in claim 1 wherein said aperture includes a lid.

9. The cover as claimed in claim 1 wherein said aperture includes a cover.

10. The cover as claimed in claim 1 wherein said aperture includes a plug.

11. The cover as claimed in claim 1 wherein said aperture includes an adapter adapted to be connected to a grease gun.

12. The cover as claimed in claim 1 wherein said aperture includes a raised protrusion.

13. The cover as claimed in claim 12 wherein said raised protrusion has a conical shape.

14. A cover for a hinge comprising:

a single, unitary body made from a generally stretchable material, said body forming a cavity sized to fit snuggly over generally said entire joint when said cover is in a position installed over said joint;

at least one removal tab disposed on said body, said at least one removal tab for facilitating removal of said body once installed over said joint; and at least one aperture in said body, said aperture adapted to allow a user to have access to said cavity formed by said body.

15. The cover as claimed in claim 14 wherein said body is made from a material selected from the group consisting of rubber, plastic, neoprene, and synthetic materials.

16. The cover as claimed in claim 14 wherein said aperture includes a lid.

17. The cover as claimed in claim 14 wherein said aperture includes a cover.

18. The cover as claimed in claim 14 wherein said aperture includes a plug.

19. The cover as claimed in claim 14 wherein said aperture includes an adapter adapted to be connected to a grease gun.

20. The cover as claimed in claim 14 wherein said aperture includes a raised protrusion.

21. The cover as claimed in claim 20 wherein said raised protrusion has a conical shape.

22. A cover for a hinge comprising:

a single, unitary body made from a stretchable material selected from the group consisting of rubber, plastic, neoprene, and synthetic materials, said body forming a cavity sized to fit snuggly over generally said entire joint when said cover is in a stretched position installed over said joint;

at least one removal tab disposed on said body, said at least one removal tab for facilitating removal of said body once installed over said joint; and at least one aperture in said body, said aperture having a raised protrusion adapted to allow a user to have access to said cavity formed by said body.

23. The cover as claimed in claim 22 wherein said aperture includes a lid.

24. The cover as claimed in claim 22 wherein said aperture includes a cover.

25. The cover as claimed in claim 24 wherein said aperture includes a plug.

26. The cover as claimed in claim 22 wherein said aperture includes an adapter adapted to be connected to a grease gun.

27. The cover as claimed in claim 22 wherein said raised protrusion has a conical shape.

* * * * *

UNITED STATES PATENT AND TRADEMARK OFFICE

CERTIFICATE OF CORRECTION

PATENT NO. : 6,735,821 B1
DATED : May 18, 2004
INVENTOR(S) : Christman Jr. et al.

It is certified that error appears in the above-identified patent and that said Letters Patent is hereby corrected as shown below:

Drawings,
Please change formal drawings 1-4 with attached.

Signed and Sealed this

Seventeenth Day of August, 2004

JON W. DUDAS
*Acting Director of the United States Patent and Trademark Office*